US011077460B2

(12) United States Patent
Fuller et al.

(10) Patent No.: US 11,077,460 B2
(45) Date of Patent: Aug. 3, 2021

(54) TRAVELING WATER DELIVERY DEVICE

(71) Applicant: WET, Sun Valley, CA (US)

(72) Inventors: Mark Fuller, Sun Valley, CA (US); James Doyle, Sun Valley, CA (US); Amnon Talmor, Sun Valley, CA (US)

(73) Assignee: WET, Sun Valley, CA (US)

( * ) Notice: Subject to any disclaimer, the term of this patent is extended or adjusted under 35 U.S.C. 154(b) by 0 days.

(21) Appl. No.: 14/212,106

(22) Filed: Mar. 14, 2014

(65) Prior Publication Data

US 2014/0312137 A1 Oct. 23, 2014

Related U.S. Application Data

(60) Provisional application No. 61/801,871, filed on Mar. 15, 2013.

(51) Int. Cl.
*B05B 17/08* (2006.01)
*B05B 13/04* (2006.01)

(52) U.S. Cl.
CPC ..... *B05B 17/08* (2013.01); *B05B 13/04* (2013.01)

(58) Field of Classification Search
CPC ..... B05B 17/08; B05B 13/04
USPC ..... 239/16–23
See application file for complete search history.

(56) References Cited

U.S. PATENT DOCUMENTS 1,184,274 A * 5/1916 Thompson ..... B05B 13/005 239/750
3,387,782 A * 6/1968 Mizuno ..... B05B 17/08 239/101
3,773,258 A * 11/1973 Hruby, Jr. ..... B05B 17/08 239/17
3,908,907 A * 9/1975 Beltran ..... B60S 3/042 239/752
4,158,443 A * 6/1979 Kameda ..... B05B 13/005 239/750
6,375,090 B1 * 4/2002 Beidokhti ..... 239/17
7,886,992 B2 * 2/2011 Wiseman ..... B05B 15/00 239/17

* cited by examiner

*Primary Examiner* — Christopher S Kim
(74) *Attorney, Agent, or Firm* — Maceiko IP

(57) ABSTRACT

A device to moving a water shooter is described. The device may contain features that allow the device to travel submerged in a reservoir with a water shooter attached. The device may travel along a fixed track, rotational boom, or be free swimming in order to move the water shooter within the reservoir so that unique water effects may be achieved.

21 Claims, 24 Drawing Sheets

TRAVELING WATER DELIVERY DEVICE

CROSS REFERENCE TO RELATED APPLICATION

The application claims the benefit of U.S. Provisional Application No. 61/801,871, filed Mar. 15, 2013, the contents of which are incorporated herein by reference.

FIELD OF THE INVENTION

The present invention generally relates to water displays and water delivery devices used in such display, including a water delivery device that may move during the performance of the water display.

BACKGROUND OF THE INVENTION

Various types of water displays exist, and many of them include various types of water delivery devices that shoot water into the air. Oftentimes, the water display is located in a reservoir having a floor and walls. Before the reservoir is filled with water, a network of water delivery devices may be attached to the bottom of the reservoir. This may include the water delivery devices themselves, as well as supporting lines such as electrical, water supply and other lines. After the reservoir is filled, water generally surrounds the water delivery devices, but the outlet of the water delivery device typically remains above the reservoir water level.

These existing water delivery devices may provide dramatic visual effects, but if they are fixed to the bottom of the water reservoir, there is some limitation of the visual effects they can produce. For example, fixed water delivery devices typically cannot provide the appearance of a stream of water that moves to different locations in the reservoir.

Many current fountains are described as "dancing fountains" which tends to imply that the fountain dances or moves about. However, this is an overstatement in that even the most limited human dancer moves in some form across the performance stage, whereas existing water delivery devices and nozzles, robotic or otherwise, are affixed to the ground or pool bottom and move, if they move at all, about that fixed point.

Accordingly, there is a need for a water delivery device for use in a water display that may move to provide the appearance that the water stream ejected by the device is actually moving. There is also a need for a water display having water delivery devices that may be moved during the visual display to allow water shooters to perform effects from various locations in the reservoir.

SUMMARY OF THE INVENTION

In an aspect of the current invention, a water display is described that include one or more water delivery devices that move around the display reservoir and provide the appearance that they are moving. In an embodiment described herein, a water delivery device may be mounted to a moving trolley device that travels either along a track or prescribed path, or is free moving, such as a small controllable underwater vehicle. The water delivery device may itself be movable and not need to be attached to a separate trolley for movement. That is, water delivery device may itself have wheels or other means to engage a track, boom or other means which may allow the water delivery device to travel. In this manner, the water delivery devices may move around the reservoir.

In another aspect of the current invention, several types of tracks are described. These may include a gridded track system, tracks that represent concentric circles, a boom which may rotate and on which a water delivery device may translate inward and outward radially along the boom, a rotating platform, a gimbaled arm and other types of tracks.

In another aspect of the current invention, a trolley that is not attached to any type of predetermined grid is described. This may resemble a free swimming device where the path of the water delivery device may be independent of any grid.

DETAILED DESCRIPTION OF THE PREFERRED EMBODIMENTS

Figure 1A:
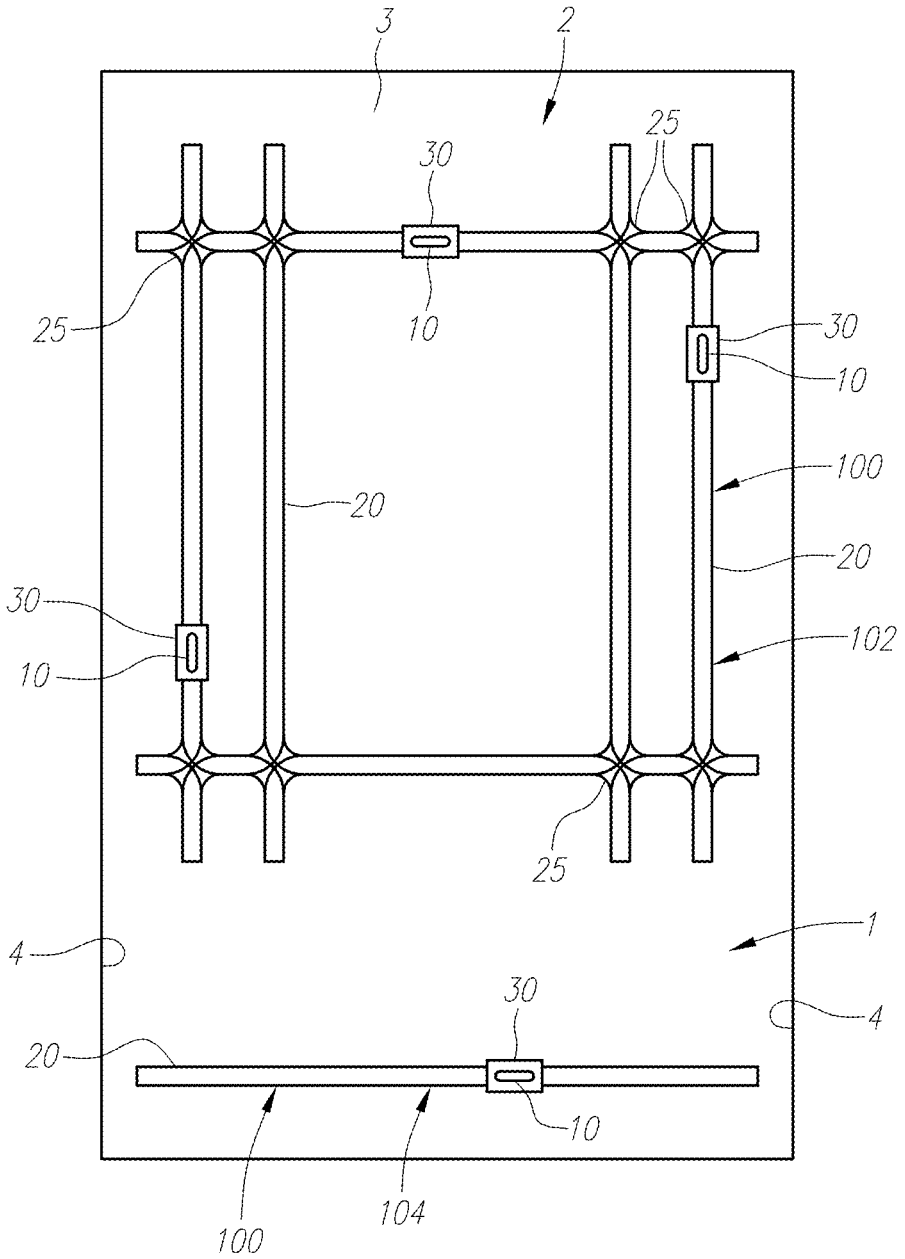
FIG. 1A is a top view of the gridded track system.

The current invention is now described with reference to the figures. Where the same or similar components appear in more than one figure, they are identified by the same reference numeral. The invention is described herein with reference to water. However, other liquids and combinations thereof are within the scope of the invention.

In general, one or more water delivery devices 10 of the current invention may form part of water display 1 that may be housed by pool or reservoir 2. Pool or reservoir 2 may include floor 3 and walls 4. After pool 2 is filled with water 5, pool 2 generally has a water surface 6. As discussed later, FIGS. 8A-8E, 9A-9F and 10A-10F show examples of different displays 1 in reservoir 2 where the water delivery devices 10 move around. But prior to discussing the display's moving appearance, the structure is first described.

Figure 1B:
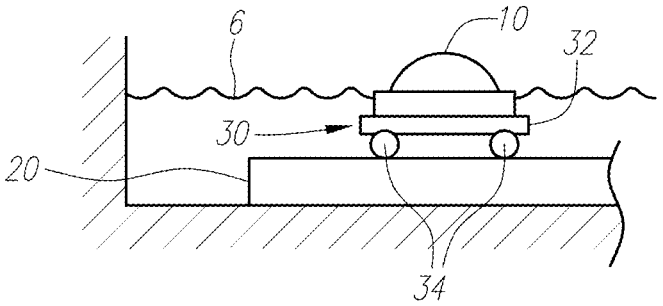
FIG. 1B is a side view of the gridded track system.

In a first embodiment, a gridded track system 100 is described with reference to FIGS. 1A, 1B and 1C. As shown in FIG. 1A track system may comprise tracks 20 and one or more trollies 30 that may move along tracks 20. Water delivery devices 10 may be mounted on trolley 30 and thus move about reservoir 2. Alternatively, device 10 may be movable in and of itself. In general, tracks 20 and trollies 30 may be submerged in reservoir 2. Water delivery device 10 may also be submerged except for its nozzle that may extend above the water surface 6 so that water shots may occur.

An example of water delivery device 10 is more fully described in U.S. Provisional Application Ser. No. 61/739,667, filed Dec. 19, 2012, the contents of which are expressly incorporated by reference as if fully set forth herein. Other examples of water shooter 20 that may be provided by WET Design, Inc. are described in the following article, the contents of which are expressly incorporated by reference as if fully set forth herein: *Making Water Dance*, Jan. 9, 2003, Machine Design.com. The article may be found at: http://machinedesign.com/article/making-water-dance-0109.

In the embodiment of FIG. 1A, track system 100 includes two separate track networks 102, 104. Network 102 shows two sets of tracks on the left and right sides and a single set of tracks at the top and bottom. Network 104 shows a single set of tracks. Though they may not be connected together, networks 102, 104 still preferably allow significant movement by water delivery devices 10 around reservoir 2.

In any event, track system 100 may comprise any number of tracks 20, trollies 30 and water delivery devices 10 mounted thereon to provide the desired water display effects. Water shooter 40 may be attached to moving trolley device 30 such that water shooter 40 is partially submerged in the water reservoir providing water to water shooter 40 to produce water display effects.

Trolley 30 is now further described. As shown in FIG. 1B, trolley 30 may include platform 32 and one or more wheels 34. Water shooter or other water delivery device 10 may be mounted to platform 32, and wheels 34 may be movably coupled to tracks 20. It is preferred that device 10 may be securely mounted to platform 32 to resist recoil from a water shot out device 10. Suitable attachment means such as brackets, bolts and other means may be used.

Similarly, it is preferred that trolley 30 be securely coupled to tracks 20. To this end, trolley 30 may include a pair of front wheels 34 and a pair of rear wheels 34. In one embodiment, wheels 34 may engage tracks 20 similar to how train wheels engage train tracks.

Trollies 30 may preferably move about the grid system 100 so that they may travel the length of track 20, make turns and return. Trolley 30 may be propelled by various means such as, but not limited to, electric motors, pneumatic propulsion or hydraulic propulsion which may involve using the water 5 of reservoir 2.

Tracks 20 and trollies 30 may comprise materials that are sustainable in water or some other fluid environment. For example, the material comprising tracks 20 and trolleys 30 may be treated to provide water resistance or covered with water resistant material where gridded track system 100 is placed in reservoir 2 containing water.

As shown in FIG. 1A, track system 100 may also include switching devices 25 so that one trolley 30 may pass another trolley 30 while both are on the same set of tracks 20. Switches 25 may be incorporated into track 20 to allow one moving trolley 30 pass a stationary moving trolley device 30 on the same track 20. Switches 25 may be comprised of components and technology of traditional railroad switches used commonly throughout the world and may consist of, but is not limited to, single slip switches, double slip switches or crossovers.

Track system 100 may also include other means for allowing moving trollies 30 to pass each another. For example, one line of track 20 may be designed to pass underneath another line of track 20 such that trolley device 30 and water shooter 40 may be momentarily submerged in the reservoir (not shown). In this embodiment, the lower track 20 is positioned far enough below the upper track 20 so that the height of trolley 30 and shooter 10 accommodated. Here, the device 10 may be turned off prior to it submerging and after it passes under the upper track 20, it may then emerge above the water surface 6 and perform another water shot. Switches 25 may be used with the upper/lower track configuration to facilitate travel of moving trollies 30.

Figure 1C:
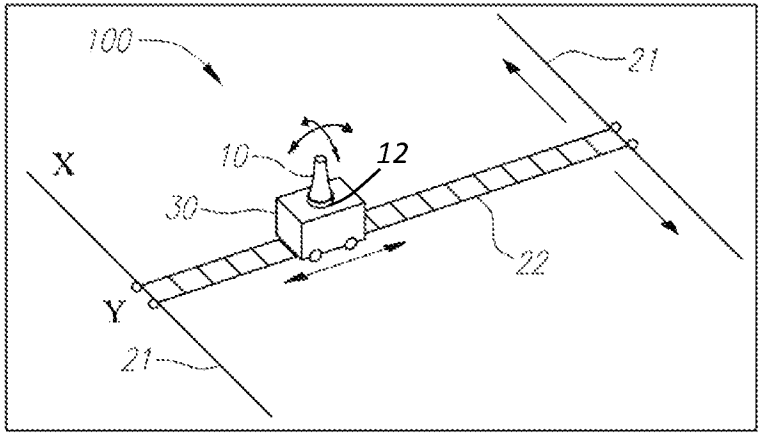
FIG. 1C is a perspective view of another gridded track system.

Another embodiment for grid track system 100 is shown in FIG. 1C. Here, parallel tracks 21 may extend for some length of reservoir 2. Tracks 21 may be single tracks. Double track 22 may extend between tracks 21 and may also support trolley 30 and water delivery device 10. In this embodiment, trolley 30 may move back and forth along double track 22 while double track 22 may move back and forth along single tracks 21. These two degrees of movement may provide significant movement for device 10 around reservoir.

Water delivery device 10 may also be mounted to trolley by a gimbal 12 so that additional visual effects may be provided as trolley 30 moves. That is, shooter 10 may move in the directions shown by the arrows. So while shooter 10 moves about reservoir 2, it may eject a stream of water that may tilt, etc.

Figure 1D:
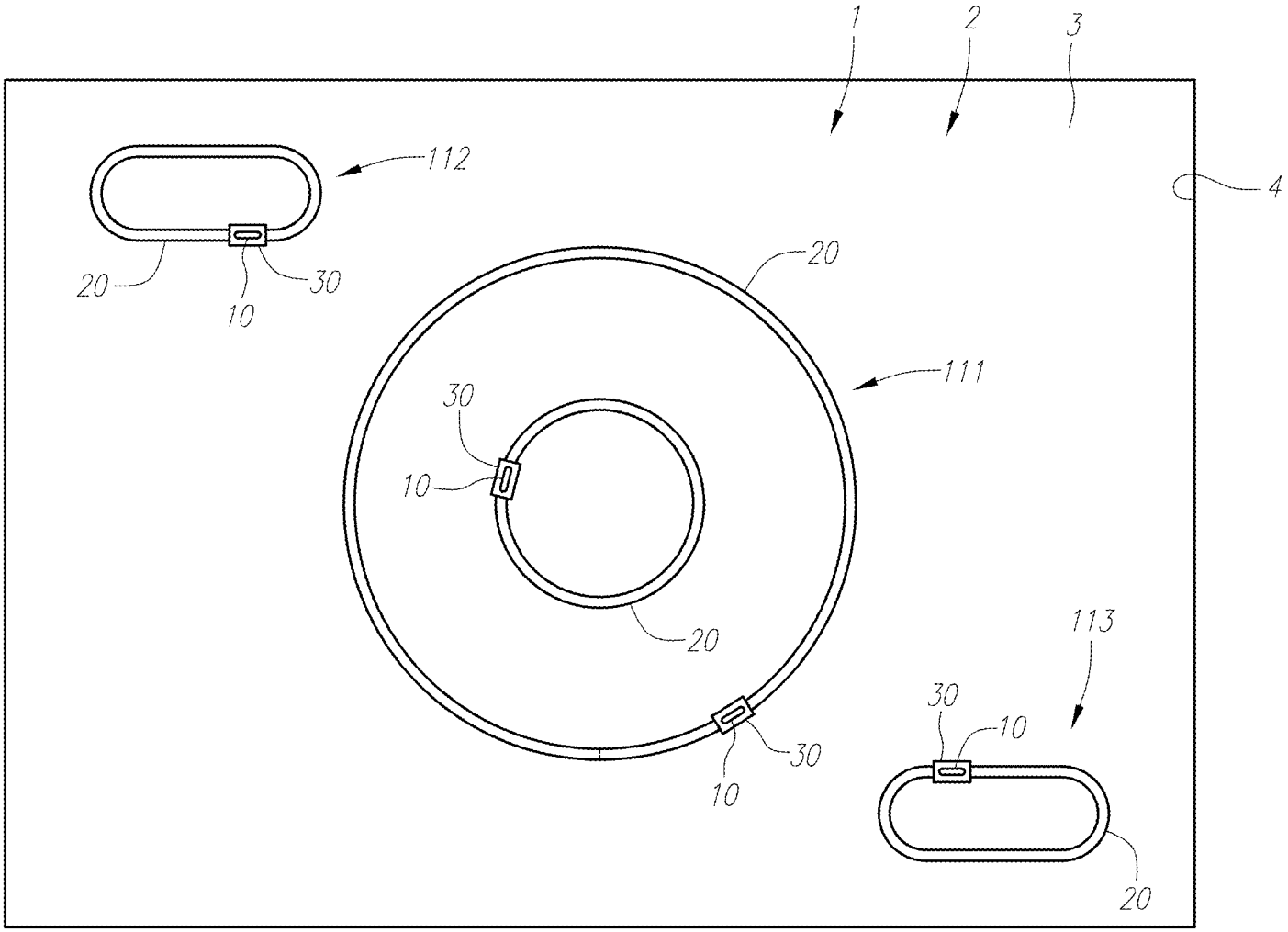
FIG. 1D is a top view of a circular track system configuration.

Another embodiment of track system 100 involving circular tracks 20 is now described with reference to FIG. 1D. As shown, display 1 may reside in reservoir 2. Display 1 may comprise track networks 111, 112, 113. Network 111 may include two circular tracks 20 arranged in a concentric arrangement. Networks 112, 113 may be configured in ovals as shown. In any event, various types of networks having curved sections may be used, and the current invention is not limited to circles and ovals. Any number of water shooters 10 may be attached to moving trolley devices 30 on any of these networks.

Figure 2C:
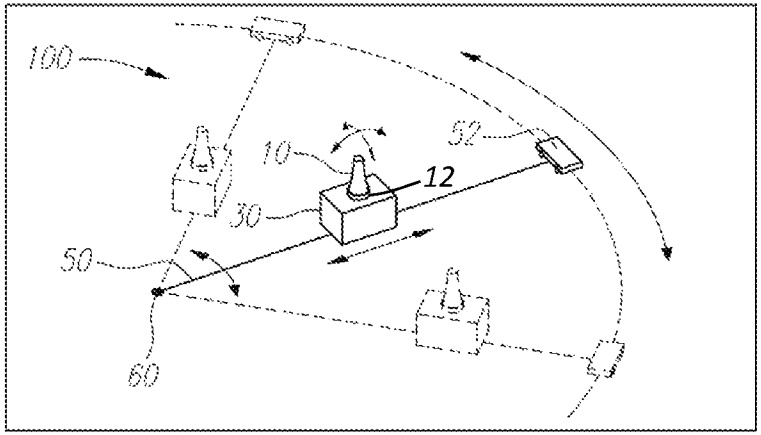
FIG. 2C is a perspective view of the rotating boom track.
Figure 2A:
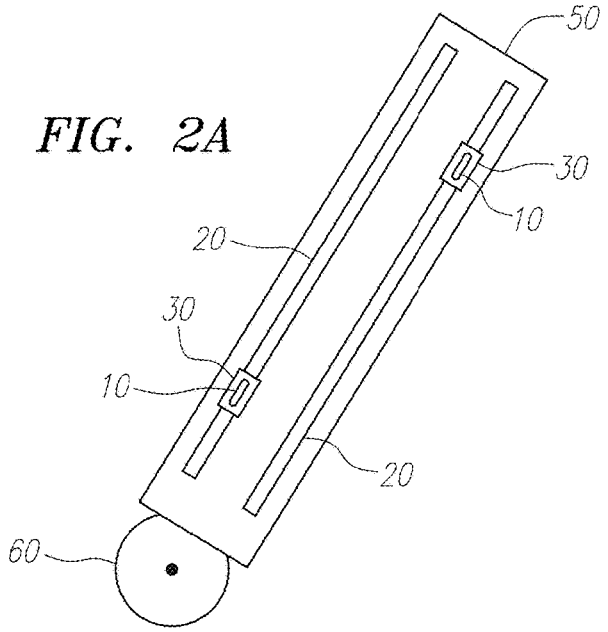
FIG. 2A is a top view of the rotating boom track.

Another embodiment of track system 100 involving a rotating boom 50 is now described with reference to FIGS. 2A and 2B. As shown in FIG. 2A, rotating boom 50 may be attached at one end to pivot 60. Boom 50 may include tracks 20 on which trollies 30 may travel. Water delivery devices 10 may be mounted to trollies 30 in the same manner discussed above. One or more sets of tracks 20 may be attached to rotating boom 50, and one or more moving trolley devices 30 containing water shooters 10 may travel on tracks 20. In general, boom 50, pivot 60, tracks 20, trolley 30 and most of device 10 may be submerged.

Rotating boom 50 may be attached to pivot or rotation device 60 at one end. Rotation device 60 may rotate rotating boom 50 while trollies 30 may travel along the length of boom 50. This provides several degrees of movement for water delivery device 10 across reservoir 2.

Figure 2B:
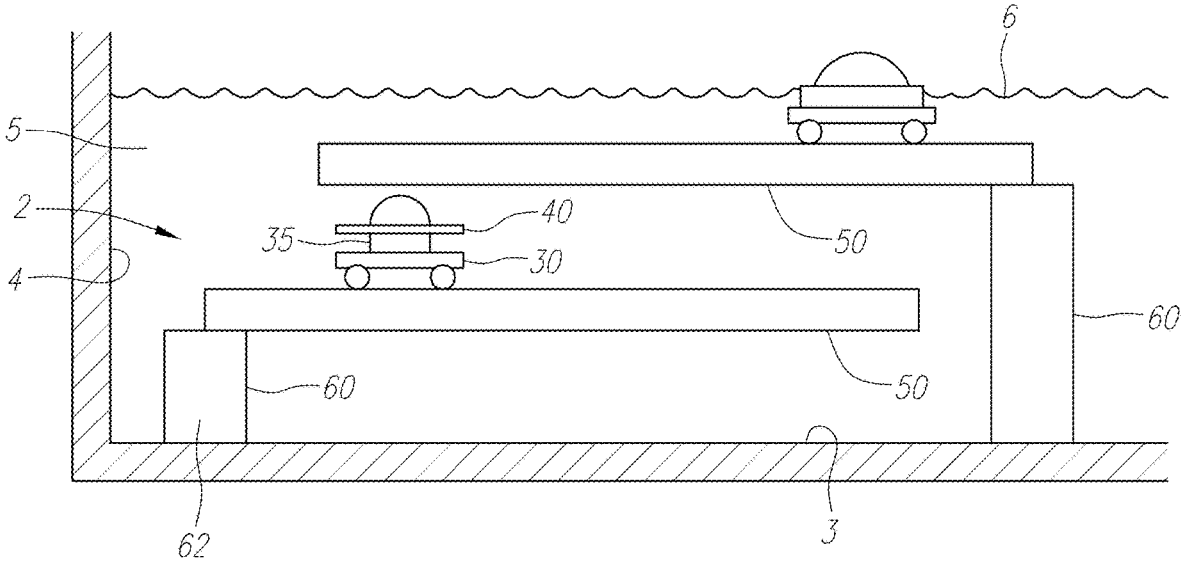
FIG. 2B is a side view of the rotating boom track.

FIG. 2B shows a side view of rotating boom 50. As shown, rotating booms 50 may be supported by pivots 60 which may in turn be mounted to the reservoir floor 3. Where multiple rotating booms 50 are present, and it is desired that their path intersect, one boom 50 may be mounted lower in reservoir 2 than the other boom 50 so that they do not hit each other when their paths intersect.

However, because the nozzle of the lower device 10 should still extend above the water surface 6 when performing water shots, device 10 or trolley 30 may include an elevation device 35 that may allow water shooter 10 to be lowered when upper boom 50 and lower boom 50 coincide. To this end, elevation device may typically extend the nozzle of lower shooter 10 above the water surface 6 but may retract it upon intersection of booms 50. Alternatively, one of the pivots 60 may include an elevation device 62 that lowers boom 50 when upper and lower booms 50 coincide.

It is preferred that the length of boom 50 not overtax the attachment with pivot 60 by providing too excessive a cantilever force. To this end, the length of may be affected by its weight and the forces generated as trollies 30 move along its length. In any event, it is preferred that boom may provide some buoyancy to help support it. Also, the distal end of boom 50 may include a support trolley (not shown) that may travel across the reservoir floor 3.

Another embodiment involving rotating boom 50 that moves about pivot 60 is now described with reference to FIG. 2C. As shown, trolley 30 may move along the length of boom 50 as boom 50 rotates. In this embodiment boom support 52 may support the distal end of boom 50. As shown, additional degrees of movement of shooter 10 may be provided by mounting shooter 10 on a gimbal 12 which is in turn mounted on trolley 30. As shown by the phantom lines in FIG. 2C, shooter 10 may assume different positions along the length of boom 50 as boom rotates.

Figure 3B:
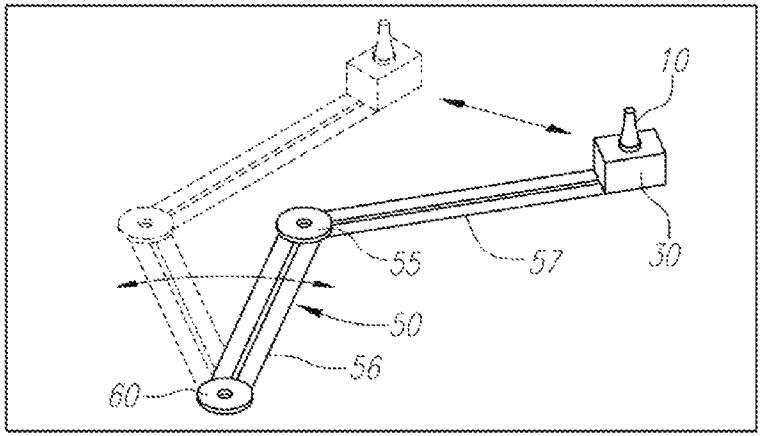
FIG. 3B is a perspective view of the rotating book track with a pivot point.
Figure 3A:
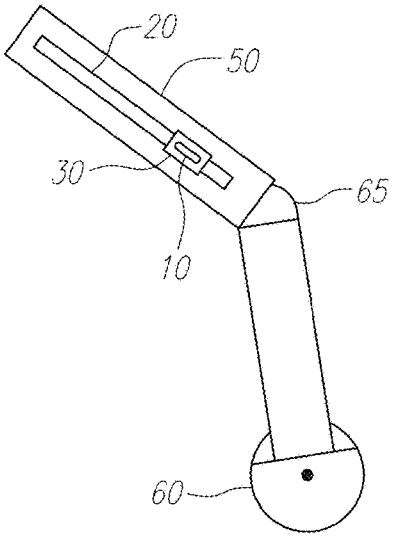
FIG. 3A is a top view of the rotating boom track with a pivot point.

Another embodiment of track system 100 involving a rotating boom 50 that includes a joint so that boom 50 may operate as an articulating arm is now described with reference to FIGS. 3A and 3B. As shown, rotating boom 50 may include joint or rotational pivot 65 to provide additional degrees of movement for water delivery device 10. Though one joint 65 is shown, multiple joints 65 may exist along boom 50.

Rotating boom 50 with multiple rotational pivots 65 may allow for coverage of a greater area of reservoir 2 and reduce the need for elevation devices 35. That is, multiple jointed booms 50 may reside in reservoir 2, and joints 65 may position booms 50 so that they may come close but do not intersect.

Figure 4C:
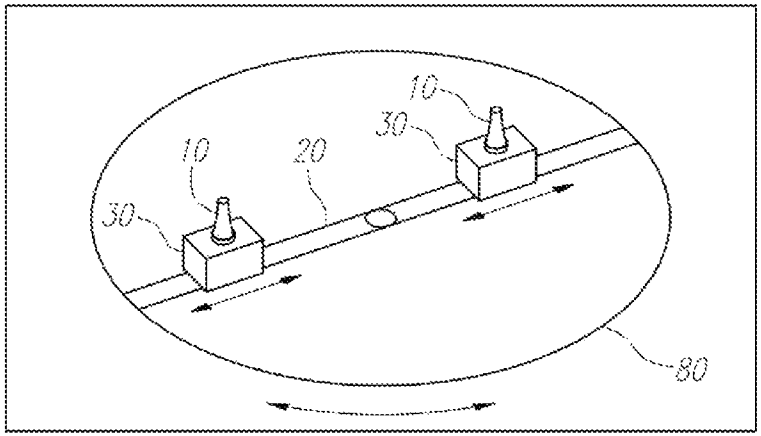
FIG. 4C is a perspective view of the rotating platform configuration.
Figure 4A:
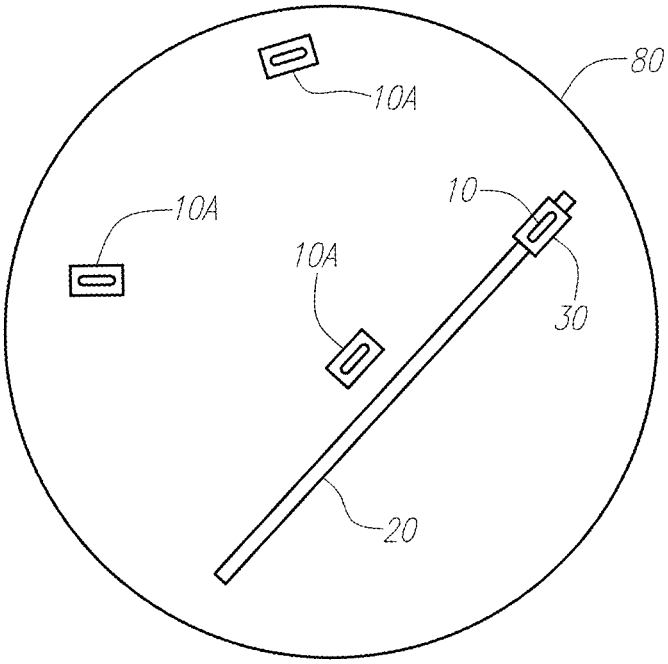
FIG. 4A is a top view of the rotating platform configuration.
Figure 4B:
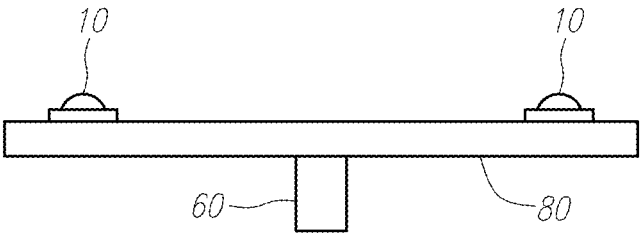
FIG. 4B is a side view of the rotating platform configuration.

Another embodiment of track system 100 of the current invention involving a rotating platform 80 is now described with reference to FIGS. 4A, 4B and 4C. As shown in FIGS. 4A and 4B, rotating platform 80 may include tracks 20, trollies 30, water delivery devices 10 and rotating device 60. In one embodiment, rotating platform 80 may include one or more fixed water shooters 10A without tracks 20 or trollies 30.

In another embodiment, platform 80 may also or alternatively include tracks 20 which allow one or more moving trollies 30 supporting water shooters 10 to travel along tracks 20 while rotational platform 80 rotates. This provides several degrees of movement for shooter devices 10. FIG. 4B shows a side view of rotational platform 80 attached to rotational device 60. Rotational device 60 may control the rate at which platform 80 rotates. The rate of rotation may coincide with music or other media. FIG. 4C shows another embodiment of rotating platform 60 where two water shooters are mounted on trollies 30 which may move along tracks 20 as platform 80 rotates.

Figure 5:
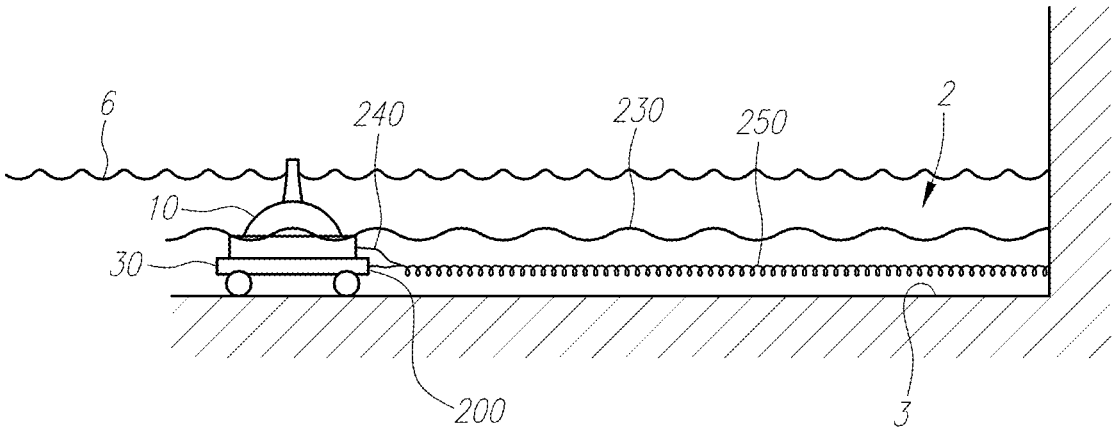
FIG. 5 shows a free swimming trolley configuration.

Another embodiment of the current invention involving a free swimming device 200 is now described with reference to FIG. 5. Free swimming device 200 may comprise trolley 30 housing a water delivery device 10. Free swimming device 200 may not require tracks 20 because it may move freely along the floor 3 of reservoir 2. FIG. 5 shows the side view of free swimming device 200 comprising traveling along floor 3.

Free swimming device 200 may be controlled by cables 250 which may include air lines 240 to actuate water shooter 10, and electric or pneumatic control lines 230. Control lines 230 may be used to drive moving trolley device 30 by various means such as, but not limited to, electric motors turning wheels or a combination of propellers and fins. The direction of free swimming device 200 may also be controlled by a wireless network (not shown). Multiple free swimming devices 200 may be used separate from or in conjunction with other track systems 100.

Free swimming device 200 may be controlled by sensors connected to a computer/microcontroller (not shown) that may receive inputs from the sensors. In other words, free swimming device may decide where to go according to what it senses; i.e. it may act as an autonomous robot. Such autonomous control may be complete so that device 200 may make all its decisions, or control may be partial, for example, the movements of device 200 may be controlled by an independent software program outside of the sensor/computer/microcomputer system referenced above, but the autonomous sensor system may take over if a sensor detects a collision. Alternatively, device 200 could have other levels of autonomous control.

Figure 6:
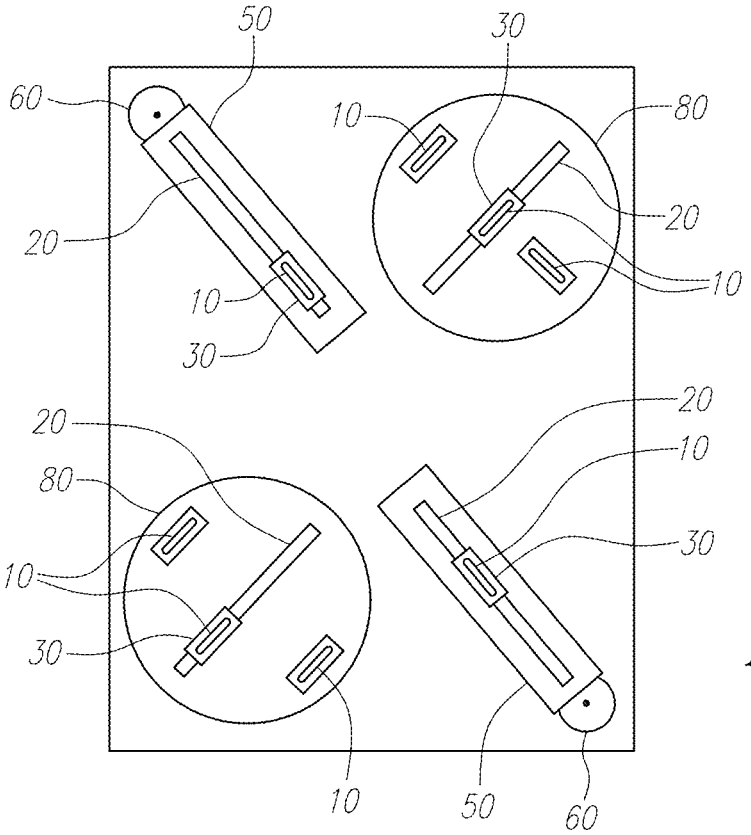
FIG. 6-7 show examples of possible displays incorporating multiple configurations.
Figure 7:
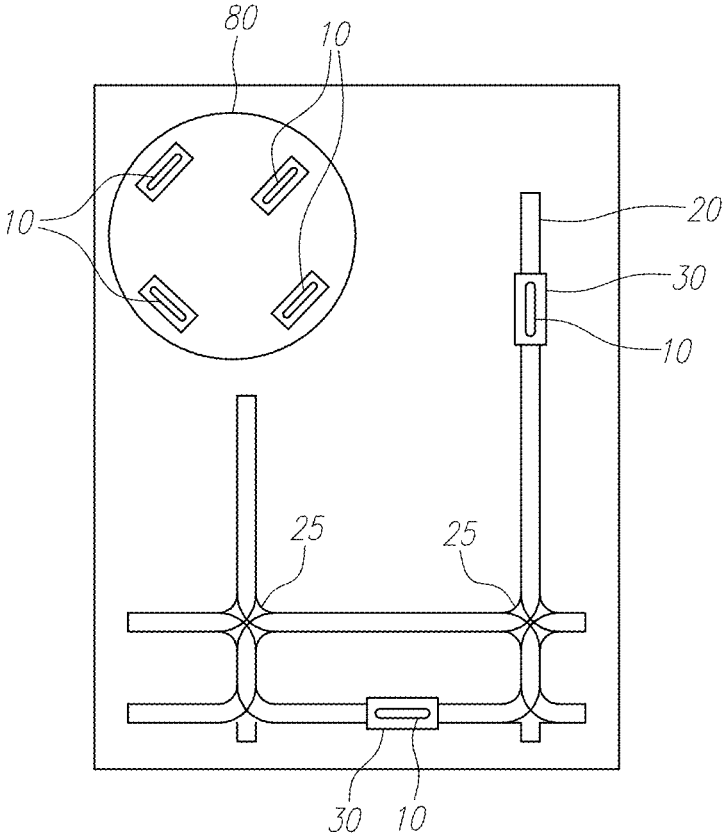
Figure 8A:
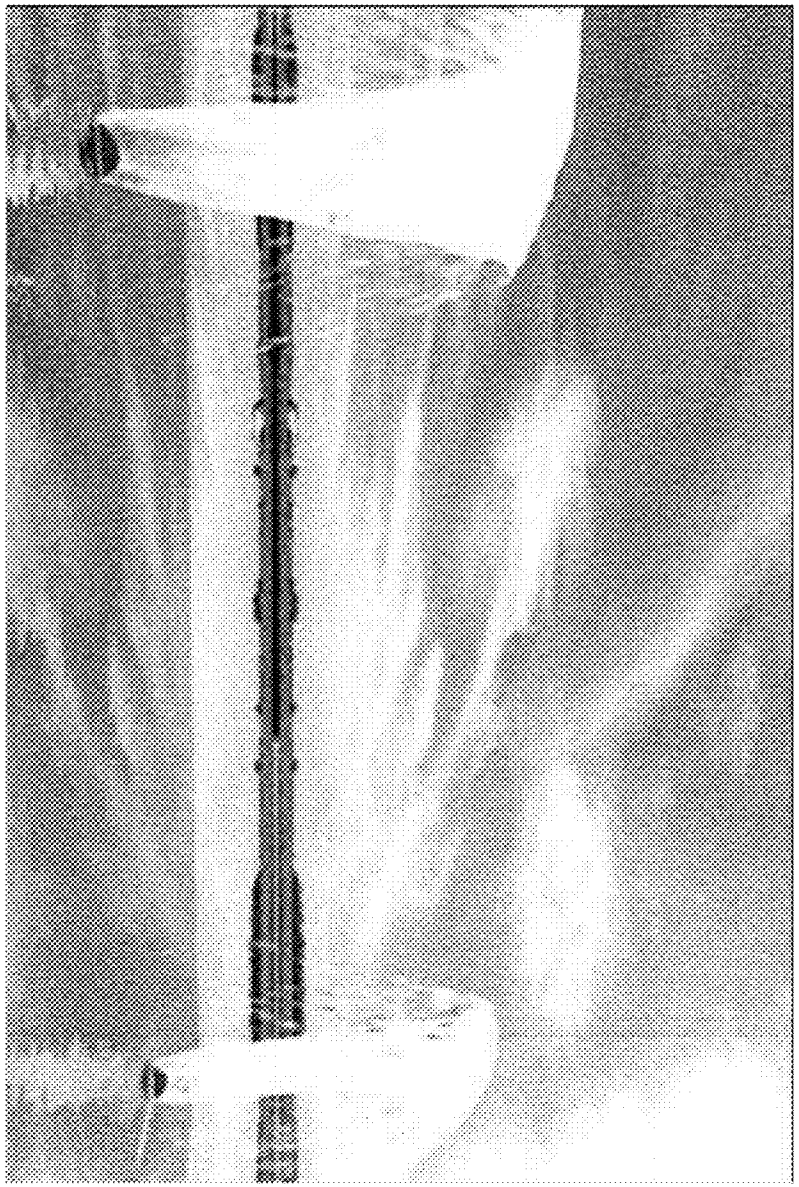
FIGS. 8A-8E is a series of pictures showing the visual effects provided by water delivery devices traveling along a circular track.
Figure 8B:
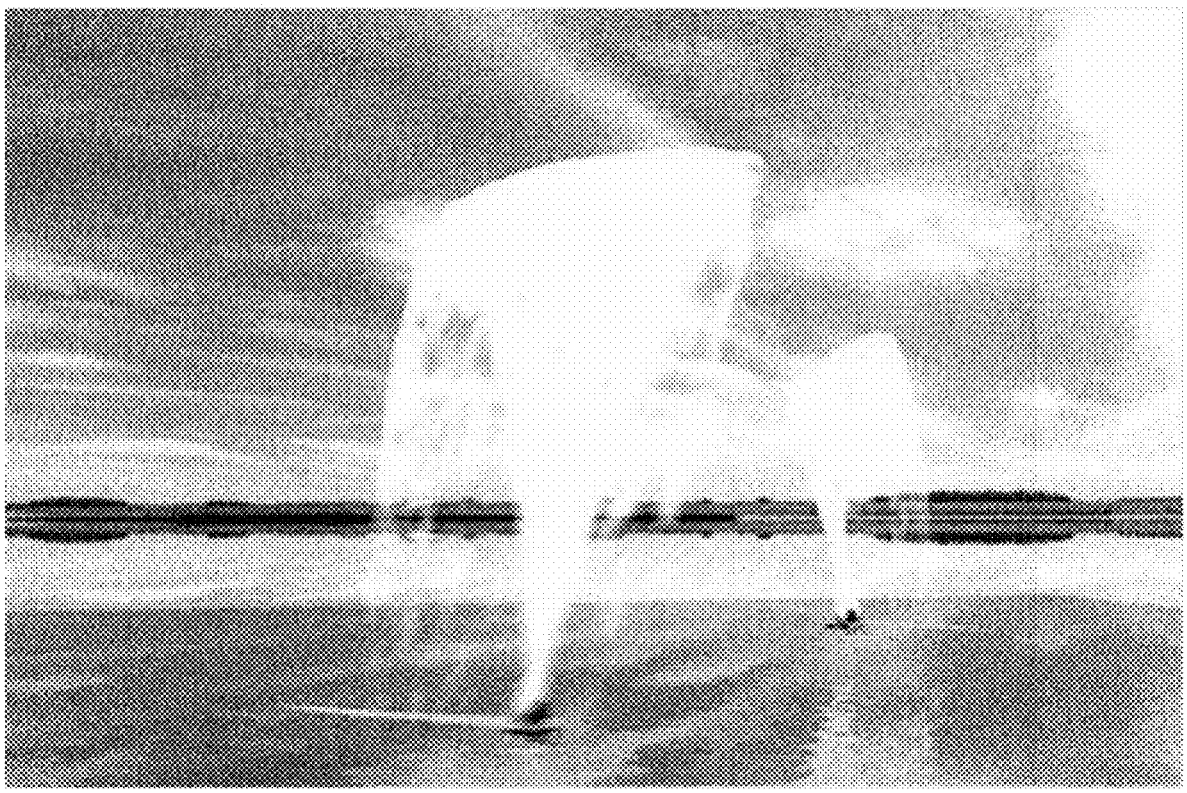
Figure 8C:
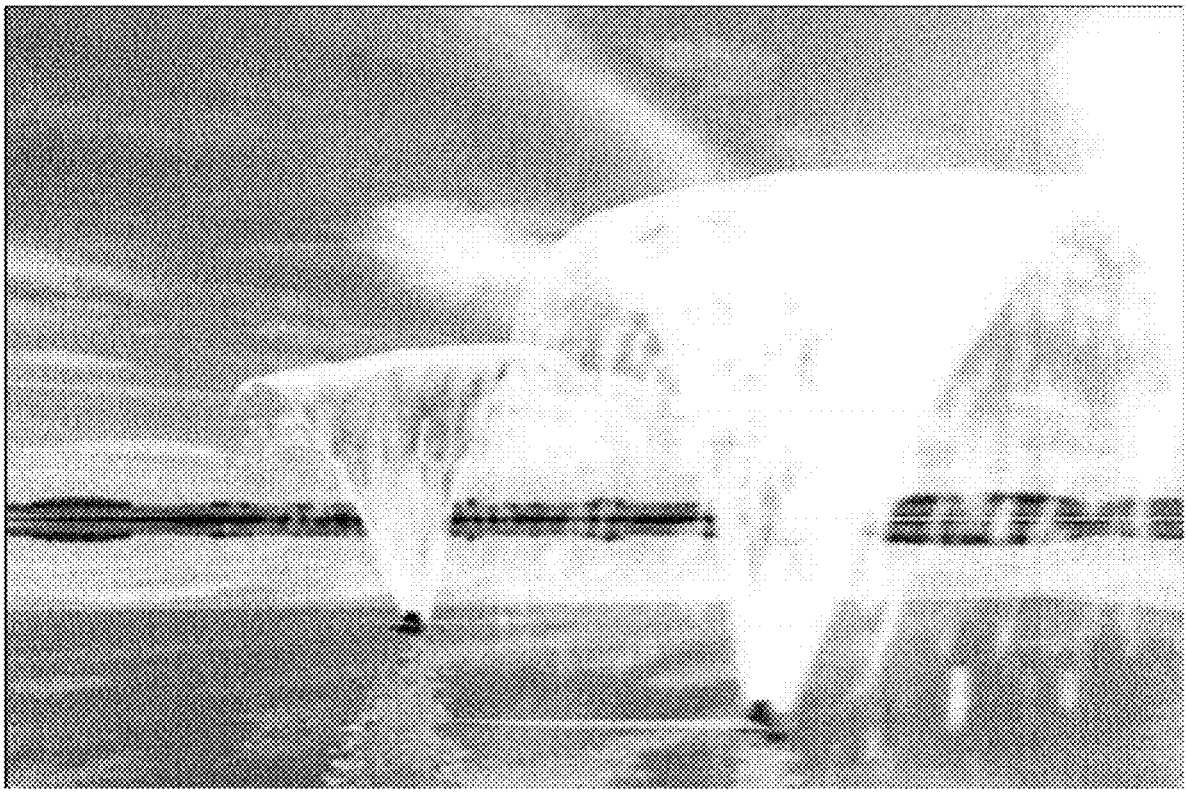
Figure 8D:
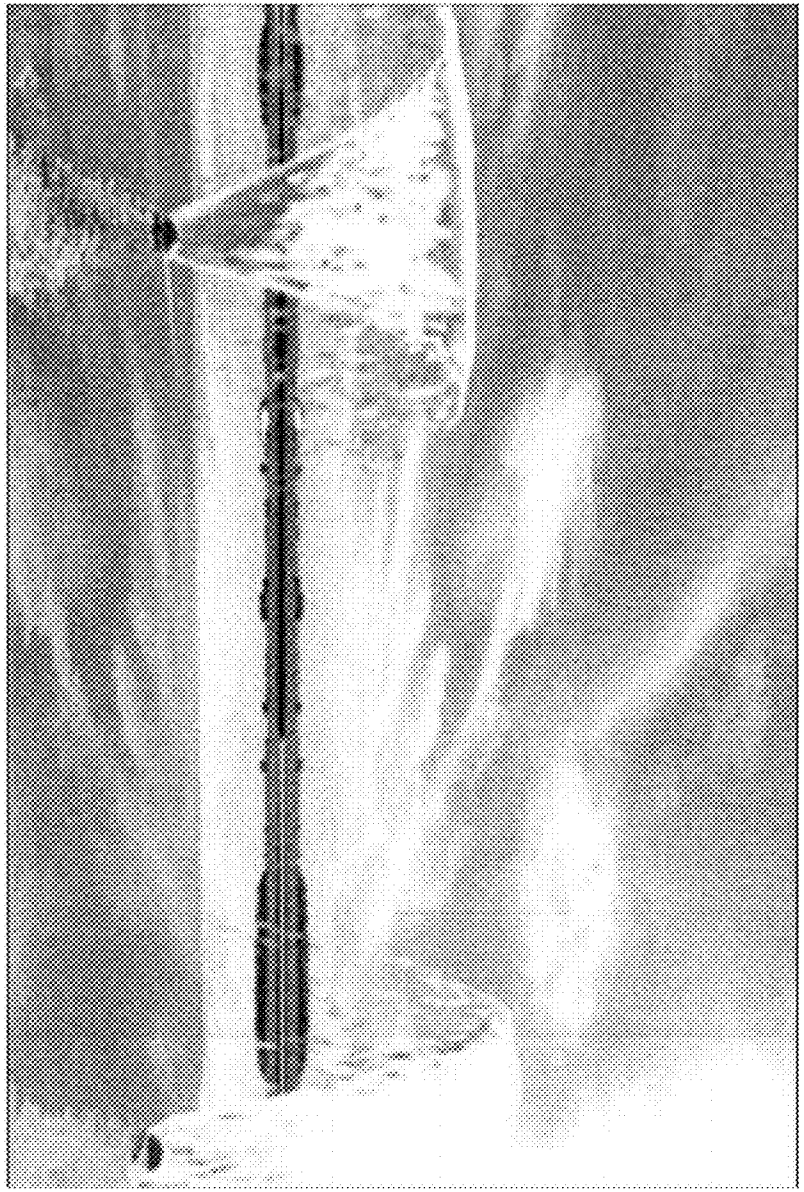
Figure 8E:
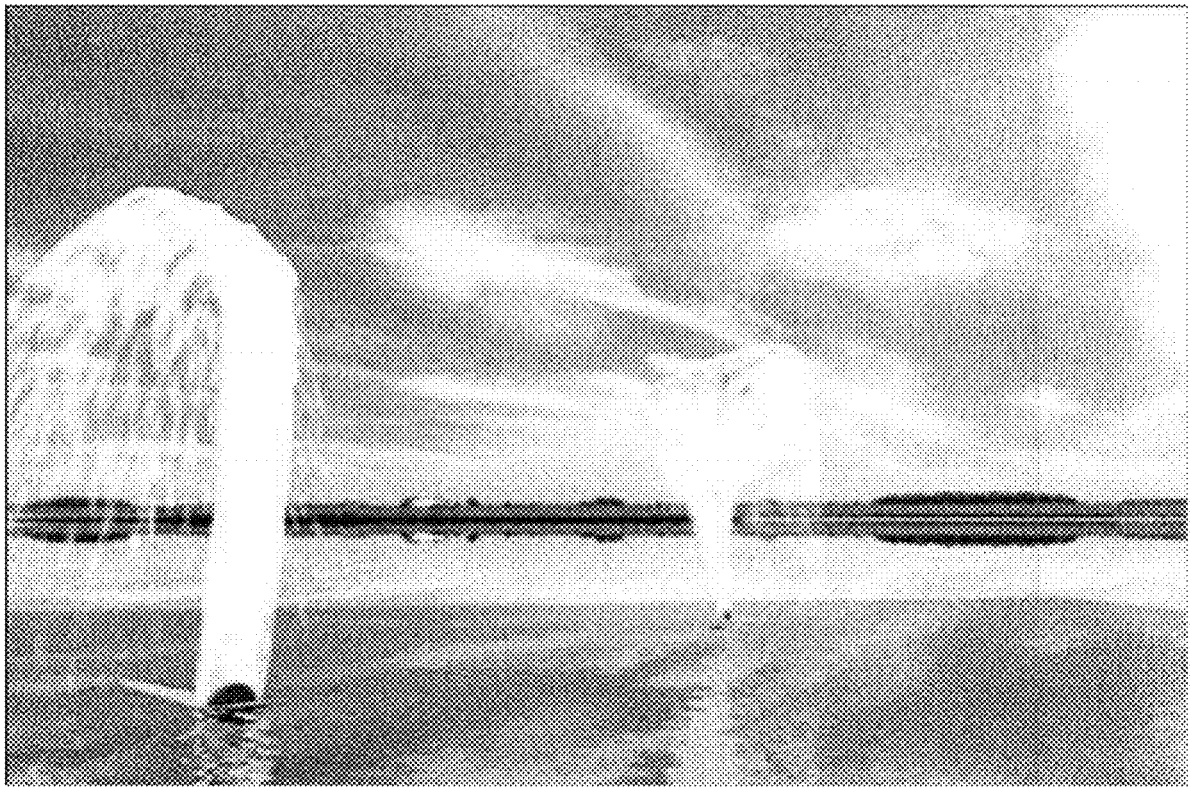
Figure 9A:
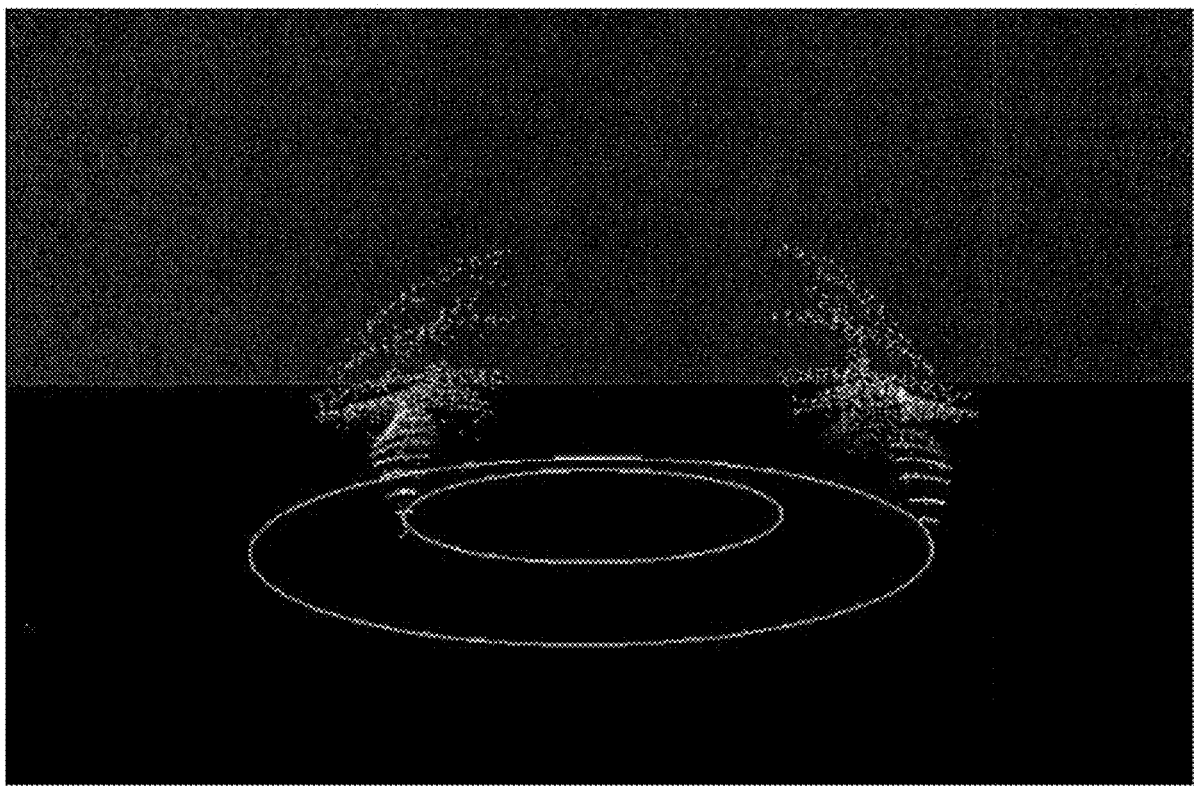
FIGS. 9A-9F is a series of pictures showing the visual effects provided by water delivery devices traveling along concentric circular tracks.
Figure 9B:
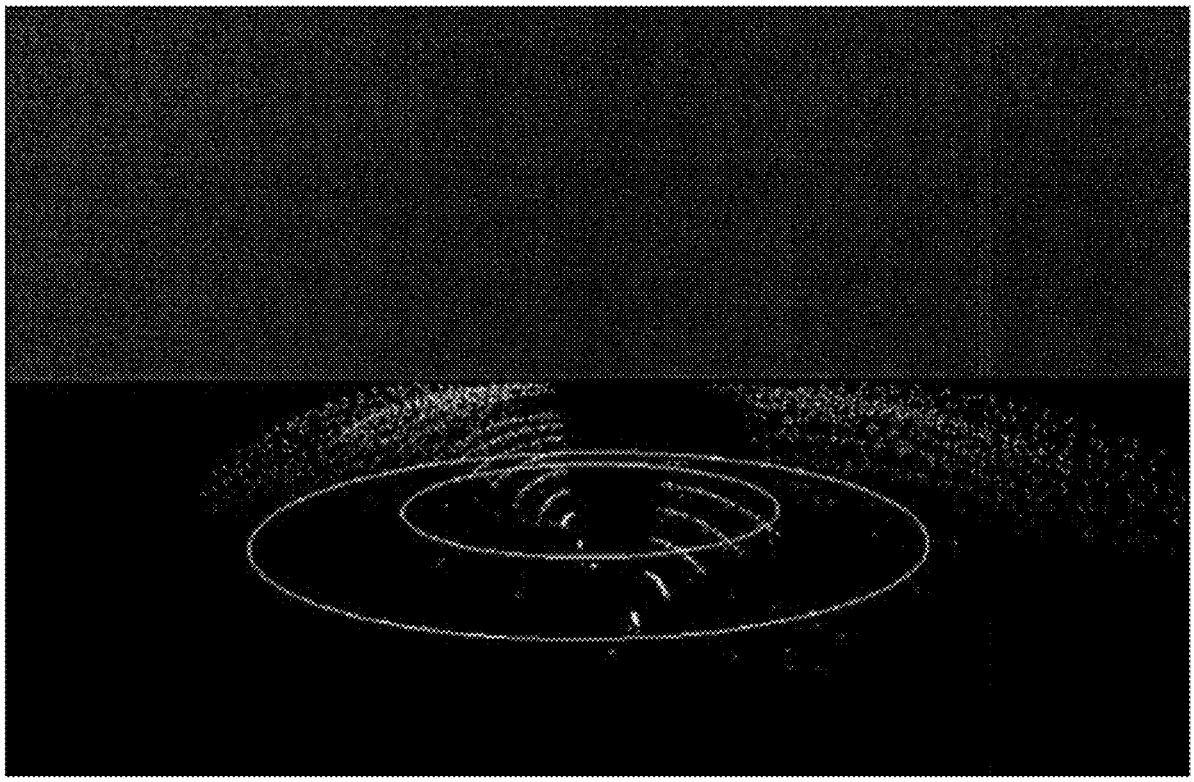
Figure 9C:
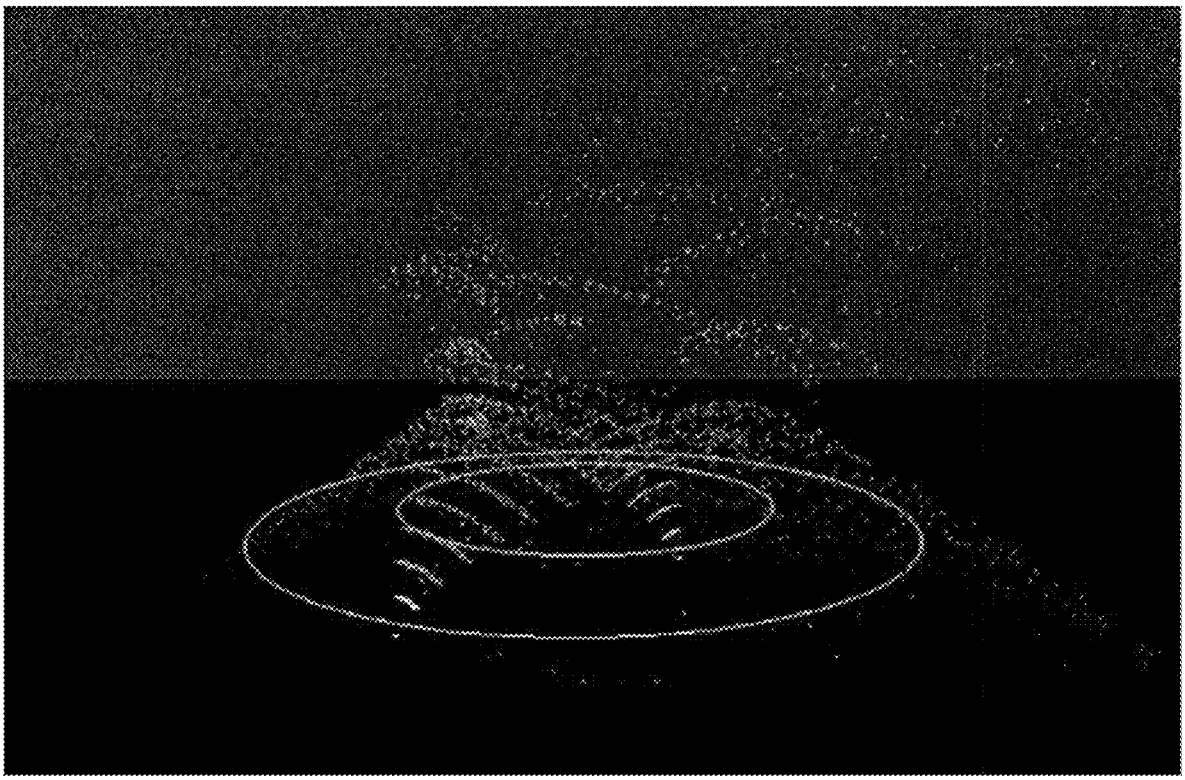
Figure 9D:
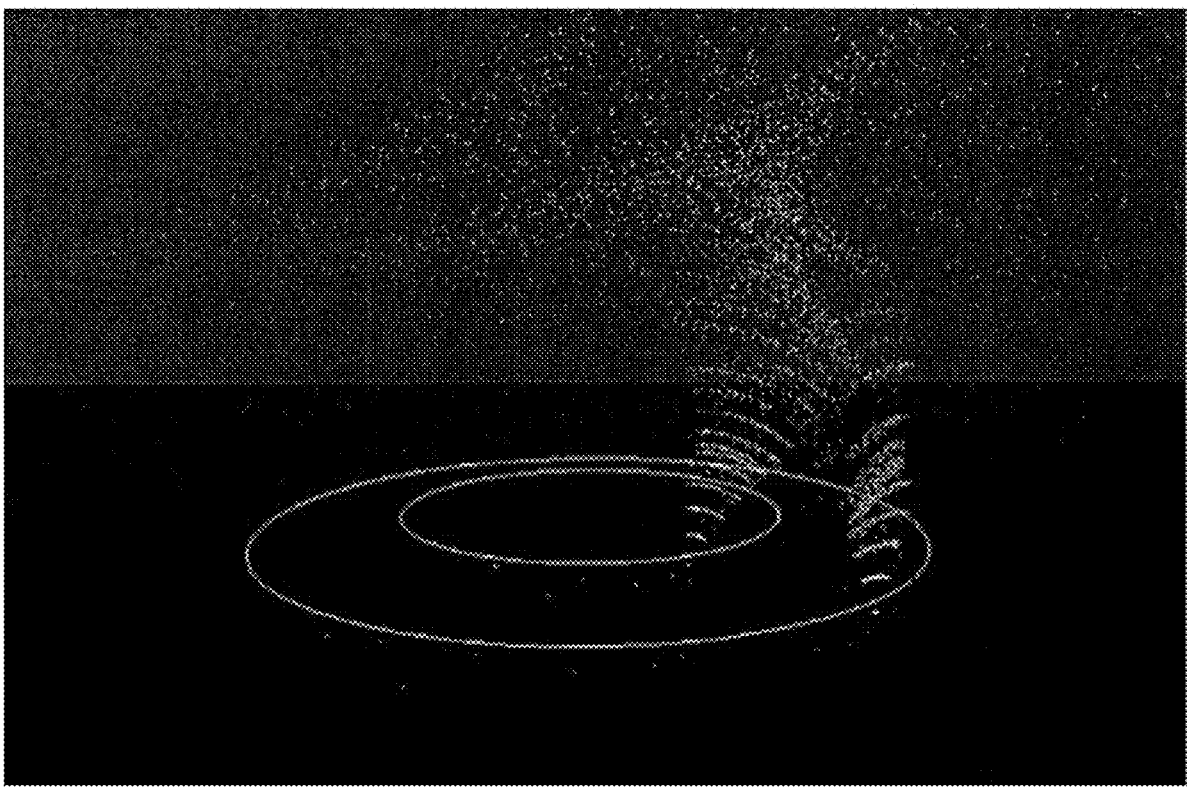
Figure 9E:
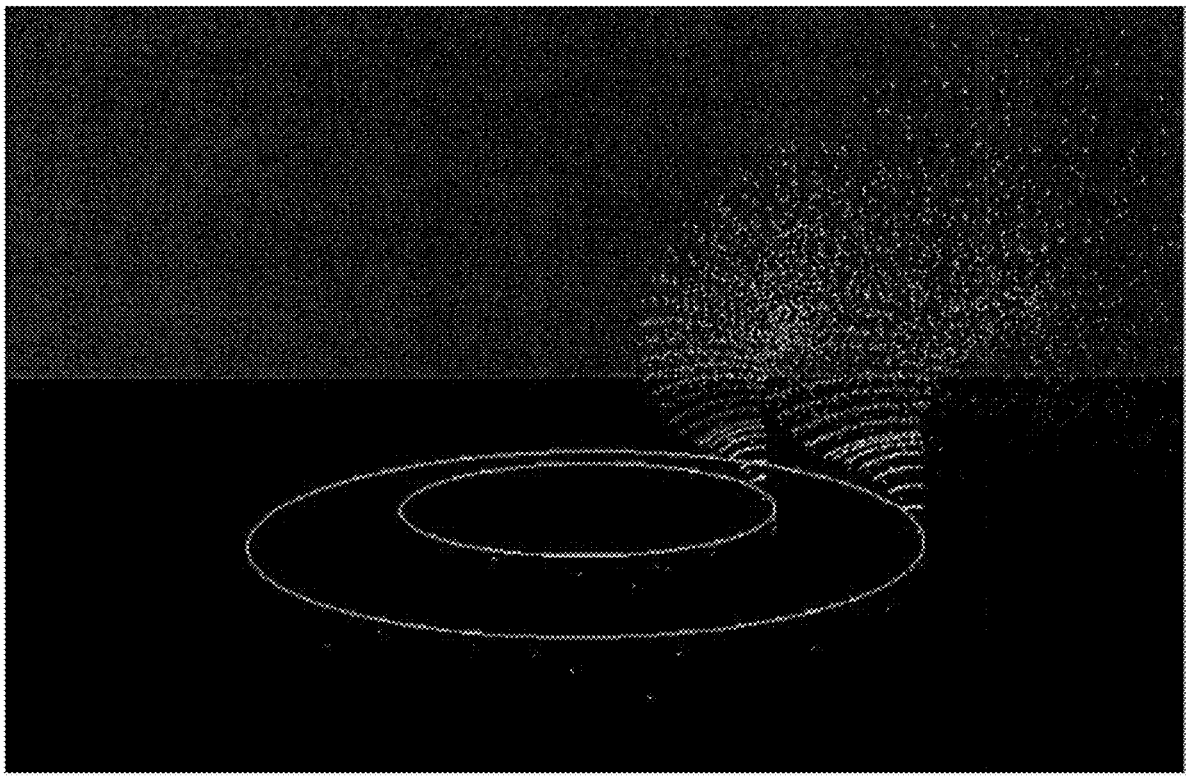
Figure 9F:
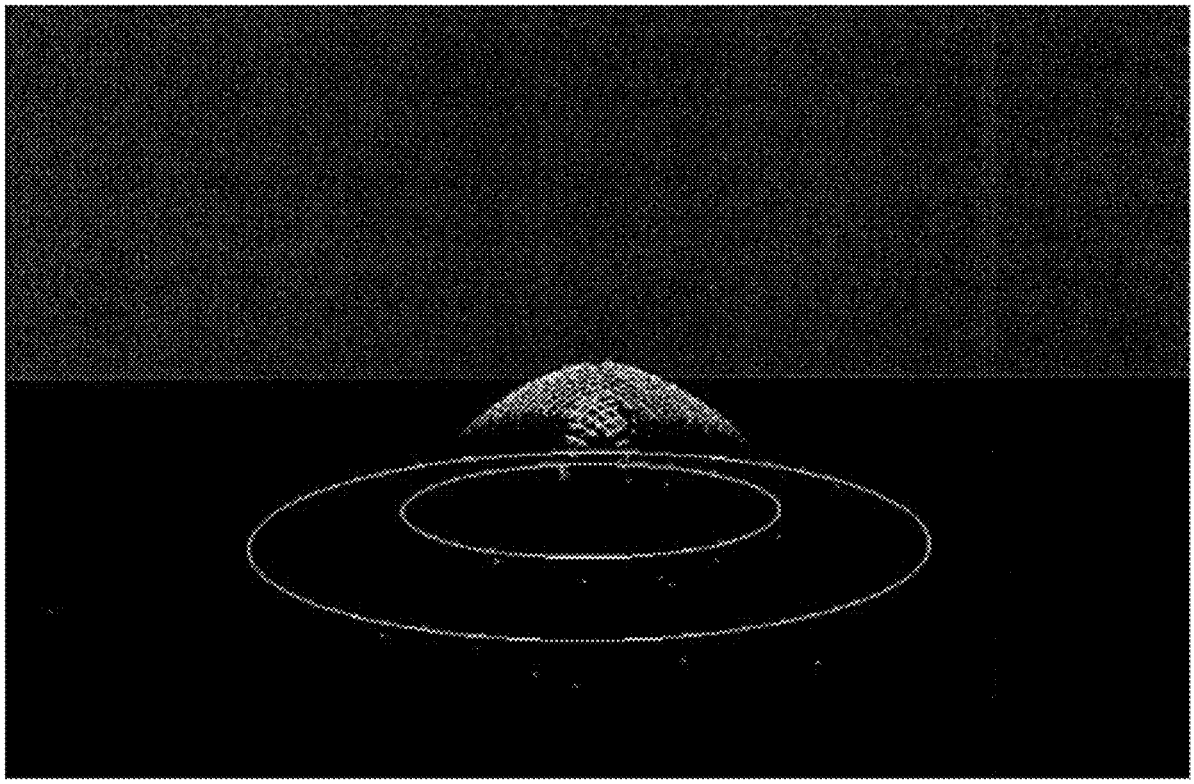
Figure 10A:
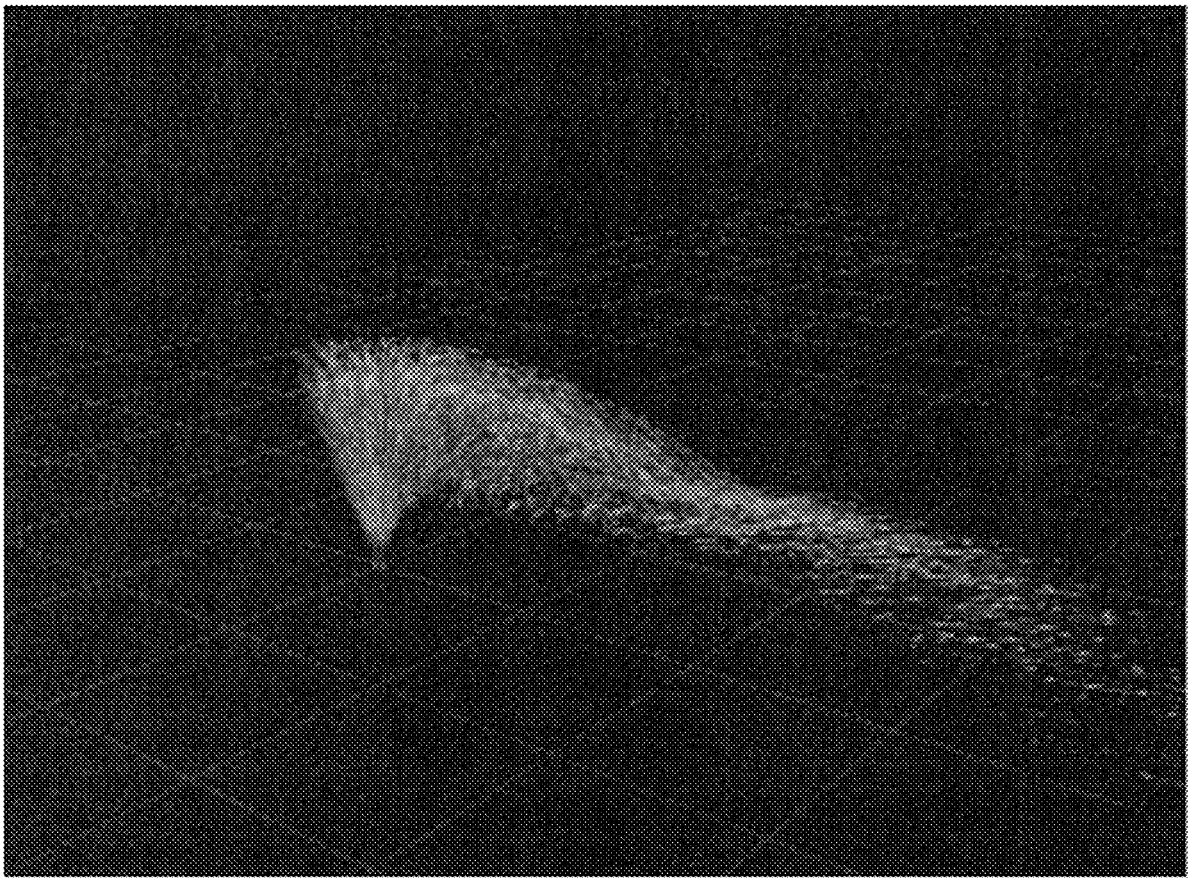
FIGS. 10A-10F is a series of pictures showing the visual effects provided by water delivery devices traveling along a gridded track.
Figure 10B:
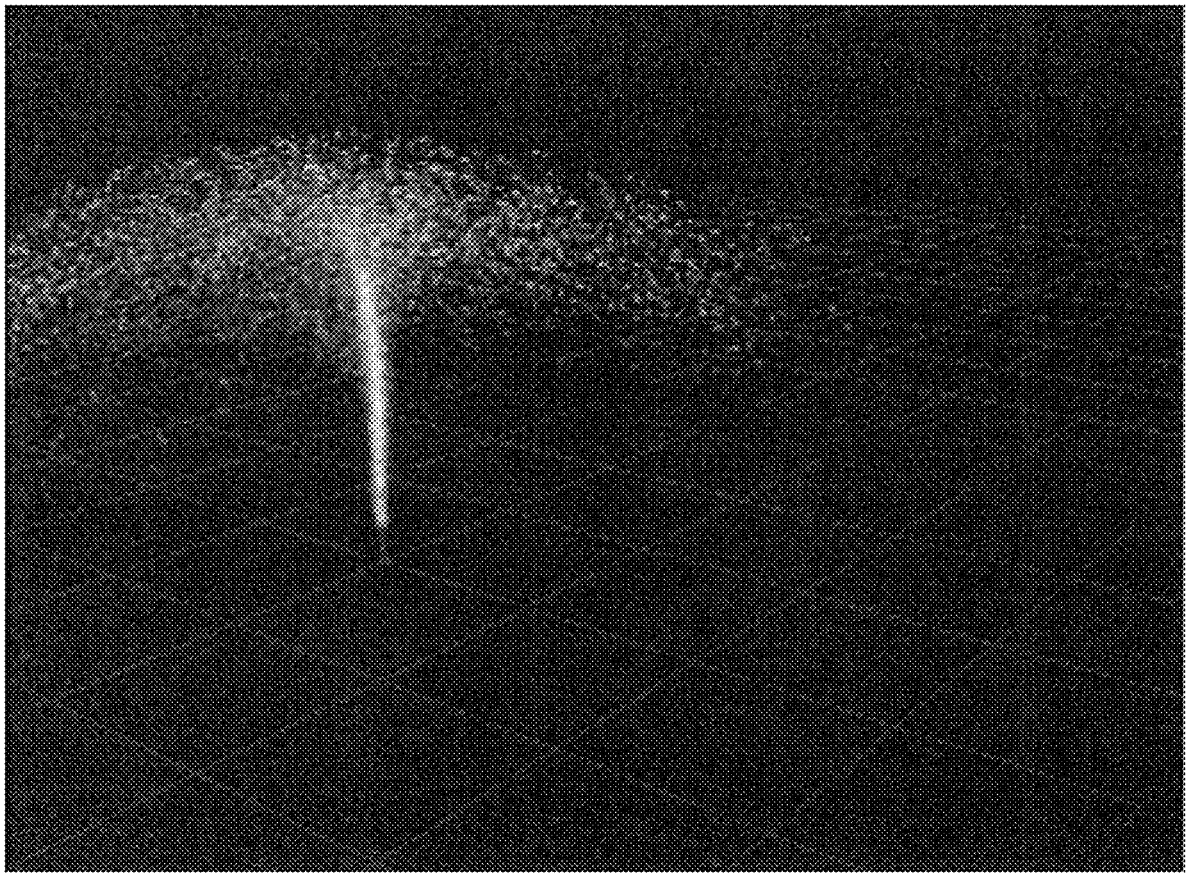
Figure 10C:
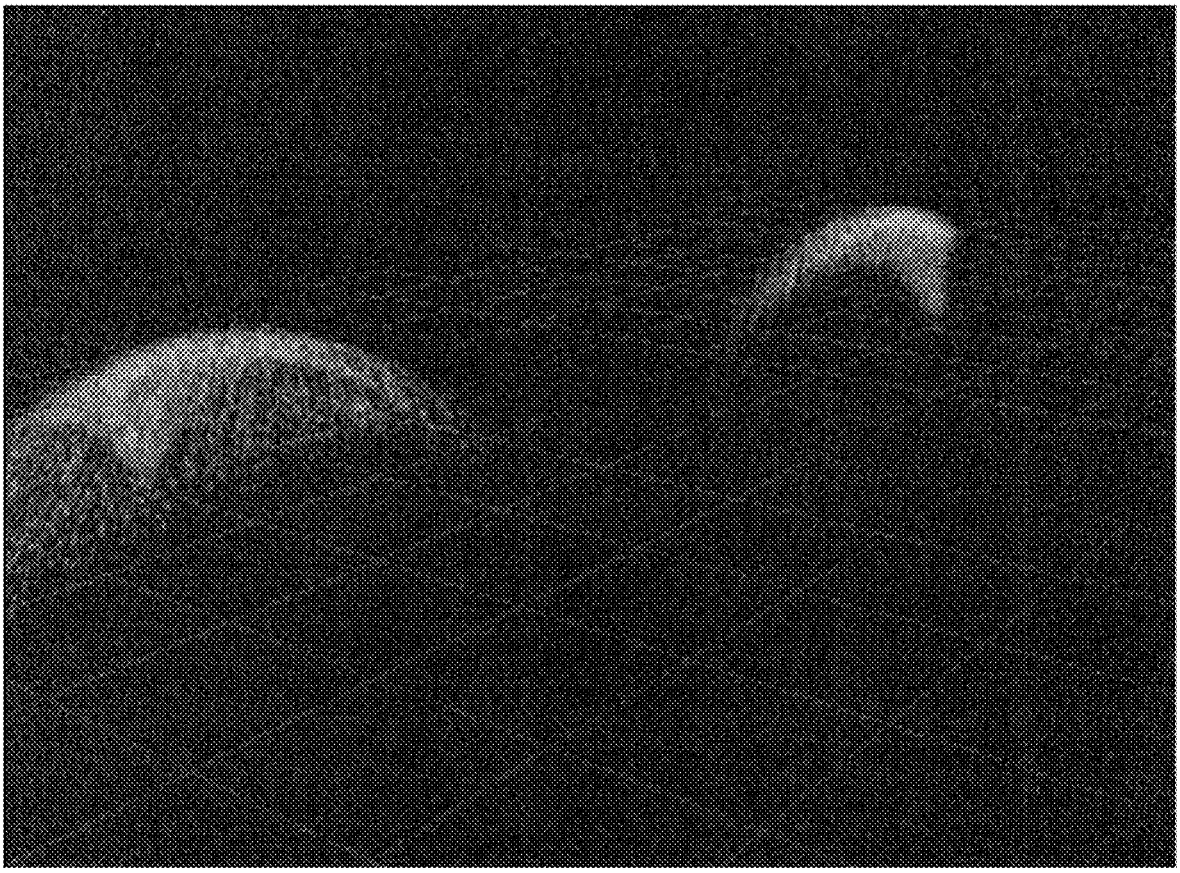
Figure 10D:
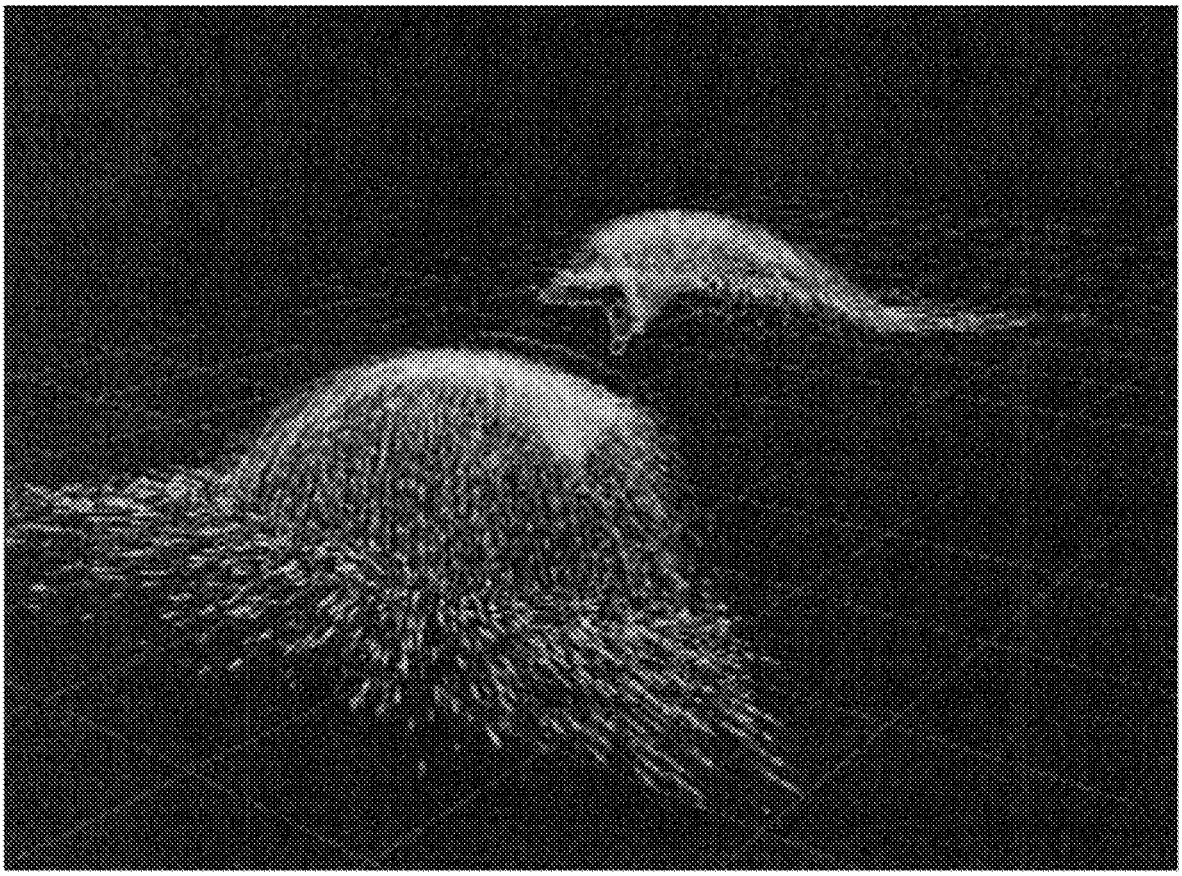
Figure 10E:
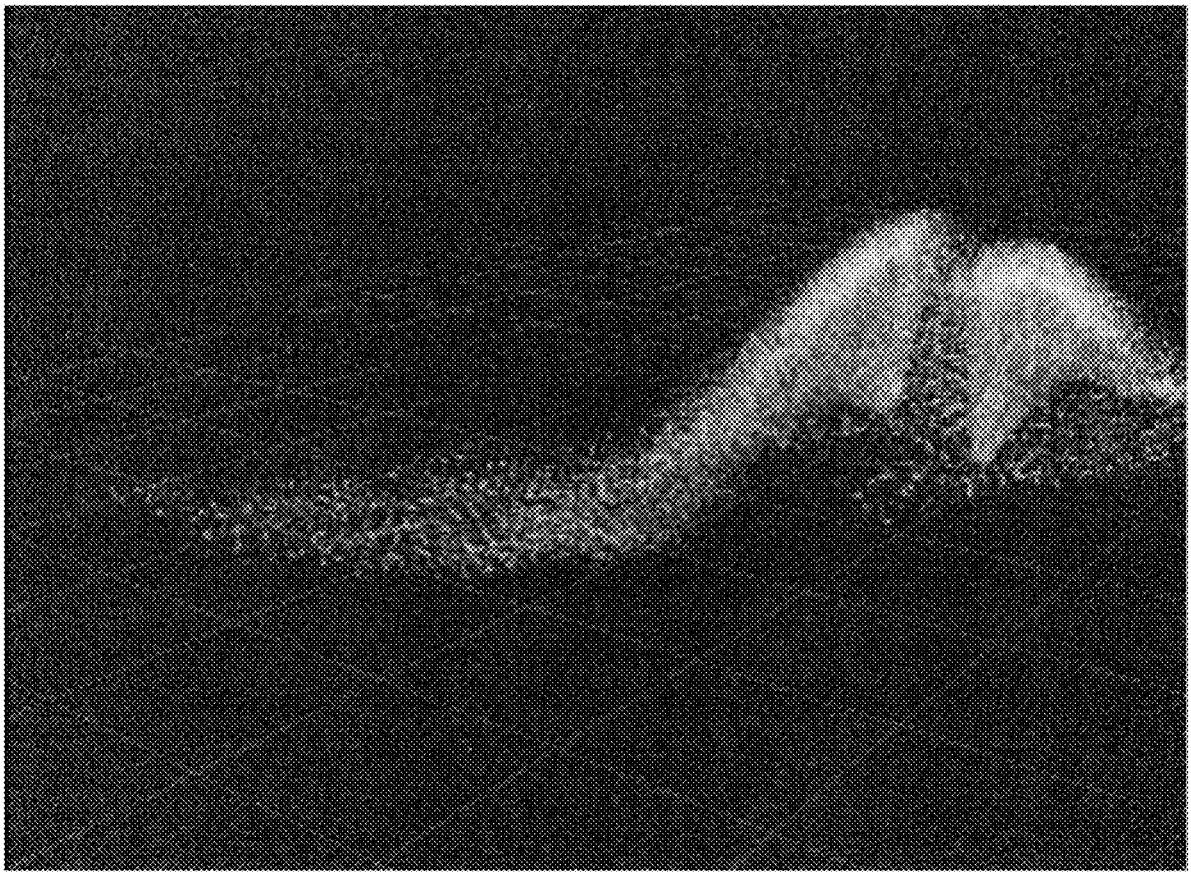
Figure 10F:
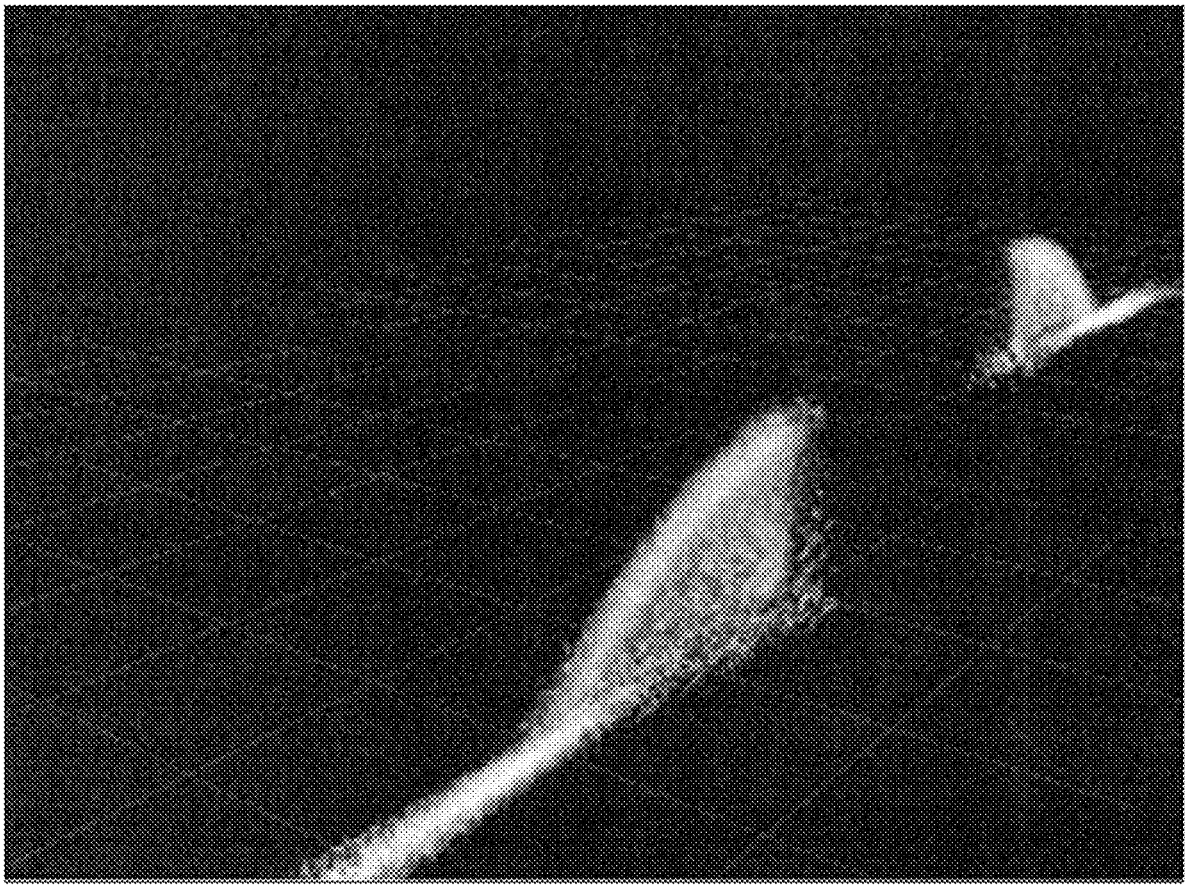

FIGS. 6 and 7 provide examples where different types of track systems 100 may be used in one water display 1 in reservoir 2. As shown, grid systems, rotating platforms 80 and other systems may be used.

Lighting effects may be added to some or all of the embodiments including, but not limited to, water shooters 40, and moving trolley devices 30. Even though rotational boom 50 and rotational platform 80 may possibly be submerged, lighting effects may also be incorporated into their design to project light from under the surface of the reservoir.

The water display performances that may be provided by the current invention are now further described with references to FIGS. 8A-8E, 9A-9F and 10A-10F. The current invention is not limited to the types of water displays shown therein since these are only examples. Instead, the current invention covers the movement of water delivery devices 10 to provide water streams that appear to move about a reservoir.

FIGS. 8A-8E show a sequence of pictures whereby two water streams are provided as their respective water delivery devices travel along a circular track. As shown, as devices 10 travel, the configuration of the water patterns they provide may vary, e.g., the width and height of the water fans may vary.

FIGS. 9A-9F show a sequence of pictures whereby two water streams are provided as their respective water delivery devices travel along concentric circular tracks. As shown, the configuration of water patterns may vary significantly as they travel about the reservoir.

FIGS. 10A-10F show a sequence of pictures whereby one, and then two water streams are provided as their respective water delivery devices travel along a grid track system. As shown, the configuration of water patterns may vary significantly as they travel about the reservoir.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A water display, comprising:

a reservoir that includes walls containing water and that includes a surface which is submerged in the water;

one or more generally circular or oval shaped tracks that are submerged in the water, and that are mounted to and extend along the submerged surface;

one or more additional tracks that are coupled to the one or more generally circular or oval shaped tracks, that are submerged in the water and that are mounted to and extend along the submerged surface;

a moveable platform that is submerged in the water and that engages the one or more generally circular or oval shaped tracks and the one or more additional tracks; and at least one water delivery device that is coupled to the submerged moveable platform and that emits a stream of water having an upward trajectory which is unobstructed and which is visible to one or more observers beyond the reservoir;

wherein the submerged moveable platform travels on the one or more generally circular or oval shaped tracks and the one or more additional tracks along the submerged surface in the reservoir and thereby moves the water delivery device to different locations in the reservoir.

2. The water display of claim 1, wherein the surface includes a track grid and the movable platform travels along the track grid.

3. The water display device of claim 2, wherein the track comprises a plurality of tracks arranged in a grid.

4. The water display of claim 1, wherein the track includes a rotating boom and the movable platform travels along the rotating boom.

5. The water display device of claim 4, wherein the rotating boom comprises a track and the movable platform travels on the track of the rotating boom.

6. The water display of claim 1, wherein at least a portion of the at least one water delivery device is submerged in the water.

7. The water display of claim 1, further comprising a rotating platform mounted to the surface, wherein the track is mounted to the rotating platform and the movable platform travels on the rotating platform.

8. The water display device of claim 7, wherein the rotating platform comprises a track and the movable platform travels on the track of the rotating platform.

9. The water display of claim 1, wherein the movable platform includes one or more wheels.

10. The water display of claim 1, wherein the water delivery device is coupled to the movable platform via a gimbal.

11. A water display, comprising:

a reservoir that includes walls containing water and that includes a surface which is submerged in the water;

a track that is submerged in the water, and that is mounted to and extends along the submerged surface;

a moveable platform that is submerged in the water and that engages the track; and at least one water delivery device that is coupled to the submerged moveable platform and that emits a stream of water having an upward trajectory which is unobstructed and which is visible to one or more observers beyond the reservoir;

wherein the submerged moveable platform travels on the track along the submerged surface in the reservoir and thereby moves the water delivery device to different locations in the reservoir; and wherein the track comprises one or more generally circular or oval shaped tracks.

12. A system for providing a moving water display, comprising:

a reservoir that includes walls containing water and that includes a surface which is submerged in the water; and a moveable platform that is submerged in the water;

at least one water delivery device that is coupled to the submerged moveable platform and that emits a stream of water having an upward trajectory which is unobstructed and which is visible to one or more observers beyond the reservoir;

a propulsion mechanism that is submerged in the water and that is coupled to the submerged moveable platform;

wherein the submerged moveable platform is propelled by the propulsion mechanism to travel along the submerged surface and thereby move the water delivery device to different locations in the reservoir;

wherein the surface includes a track and the movable platform travels along the track; and wherein the track comprises one or more generally circular or oval shaped tracks.

13. The system of claim 12, wherein the surface includes a rotating boom and the movable platform travels on the rotating boom.

14. The system of claim 13, wherein the rotating boom comprises a track and the movable platform travels on the track of the rotating boom.

15. The system of claim 12, wherein at least a portion of the water delivery device is submerged in the water.

16. The system of claim 12, further comprising a rotating platform mounted to the surface and the movable platform travels on the rotating platform.

17. The system of claim 16, wherein the rotating platform comprises a track and the movable platform travels on the track of the rotating platform.

18. The system of claim 12, wherein the movable platform includes one or more wheels.

19. The system of claim 12, wherein the water delivery device is coupled to the platform via a gimbal.

20. The system of claim 12, wherein the track comprises a plurality of tracks arranged in a grid.

21. A water display, comprising: a reservoir that includes walls containing water and that includes a submerged surface, a generally circular or oval shaped track which is submerged in the water and which is mounted on and extends along the submerged surface, and at least one water delivery device that is coupled to a moveable platform which is submerged in the water, and that emits a stream of water having an upward trajectory which is unobstructed and which is visible to one or more observers beyond the reservoir, wherein the submerged moveable platform is configured to move along the track along the submerged surface.

* * * * *